US007795791B2

(12) United States Patent
Joseph et al.

(10) Patent No.: US 7,795,791 B2
(45) Date of Patent: Sep. 14, 2010

(54) ONE PIECE SHELL HIGH THREAD SPARK PLUG

(75) Inventors: Michael S Joseph, Perrysburg, OH (US); Richard E. Callahan, Maumee, OH (US); Mark S. McMurray, Toledo, OH (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 11/833,810

(22) Filed: Aug. 3, 2007

(65) Prior Publication Data

US 2008/0030116 A1 Feb. 7, 2008

Related U.S. Application Data

(60) Provisional application No. 60/821,343, filed on Aug. 3, 2006.

(51) Int. Cl.
*H01T 13/20* (2006.01)

(52) U.S. Cl. ..... 313/141; 313/142; 313/143; 313/144

(58) Field of Classification Search ..... 313/141–144
See application file for complete search history.

(56) References Cited

U.S. PATENT DOCUMENTS

| | | | | |
|---|---|---|---|---|
| 2,309,980 | A | | 2/1943 | Ramsay |
| 2,786,158 | A | | 3/1957 | Tognola |
| 2,831,138 | A | | 4/1958 | Teasel |
| 3,013,174 | A | | 12/1961 | Logan |
| 3,037,140 | A | | 5/1962 | Schurecht |
| 3,046,434 | A | | 7/1962 | Schurecht |
| 4,952,837 | A | | 8/1990 | Matsumura et al. |
| 4,989,557 | A | | 2/1991 | Penney |
| 5,091,672 | A | | 2/1992 | Below |
| 5,186,132 | A | | 2/1993 | Runge |
| 5,697,334 | A | | 12/1997 | Below |
| 5,866,973 | A | * | 2/1999 | Kagawa et al. ..... 313/141 |
| 5,918,571 | A | | 7/1999 | Below |
| 6,104,130 | A | | 8/2000 | Below |
| 6,202,604 | B1 | | 3/2001 | Silvers |
| 6,566,793 | B2 | * | 5/2003 | Honda et al. ..... 313/141 |
| 6,655,334 | B2 | | 12/2003 | Inagaki et al. |

* cited by examiner

*Primary Examiner*—Nimeshkumar D Patel
*Assistant Examiner*—Thomas A Hollweg
(74) *Attorney, Agent, or Firm*—Robert L. Stearns; Dickinson Wright, PLLC

(57) ABSTRACT

A spark plug for igniting gases in an internal combustion engine is disclosed. The spark plug has a center electrode, an insulator, a one-piece shell, and a terminal. The center electrode is in communication with an energy source. The insulator surrounds the center electrode. The one-piece shell surrounds and contacts the insulator for securing the insulator within the shell, wherein the shell has a plurality of threads near a first end and a ground electrode attached to the shell and aligned with a tip of the center electrode at a second end to define a spark gap. Further, a seat is formed in the shell between the plurality of threads and the ground electrode for sealing the shell against the engine. The terminal has a first end in communication with the center electrode and a second end which has a connector portion for connecting to the energy source.

22 Claims, 8 Drawing Sheets

ONE PIECE SHELL HIGH THREAD SPARK PLUG

CROSS REFERENCE TO RELATED APPLICATIONS

This patent application claims priority to U.S. Provisional Patent Application Ser. No. 60/821,343, filed Aug. 3, 2006, which is incorporated herein by reference in its entirety.

BACKGROUND OF THE INVENTION

1. Field of the Invention

The present invention relates generally to spark plugs, and more particularly to spark plugs having an extended shell and insulator.

2. Related Art

Spark plugs have been used for many years to provide a means to ignite the fuel air mixture in the combustion chambers of an internal combustion engine. Spark plugs have taken on many forms to adapt to the particular engine design and environment. Generally, spark plugs have a center electrode surrounded by an insulator wherein the insulator is disposed in and captured by a metal housing or shell. The shell typically has a plurality of threads which are matched to the bore threads in the engine block. The threads allow the spark plug to be screwed into the bore using a conventional tool. Further, the shell includes a ground electrode extending from an end of the shell proximate the center electrode. The ground electrode together with the center electrode define a spark gap. The shell also acts as a ground shield to provide an electrical ground path from the spark gap to the engine block.

The spark plug seats or seals against the engine cylinder head to seal the combustion chamber and prevent combustion gases from escaping through the spark plug hole in the cylinder head. Commonly, the seat is located above the threads and is combined with a sealing gasket that has an interference fit with respect to the threads so as to retain the gasket during installation of the sparkplug.

Increasingly, engine designs employing multiple valves, fuel injection points, coil on plug ignition systems, combustion related sensors and other features have placed increasing demands on the space in the cylinder head immediately adjacent to the combustion chamber, particularly the space above the combustion chamber, which have in turn made it desirable to minimize the space envelope needed for the spark plug, particularly in the lower portions of the spark plug proximate the spark gap where the spark plug is exposed to the combustion chamber and combustion gases.

In addition to restrictions on the space envelope available for the spark plug on the sparking end, in applications where space is restricted, there is also a trend toward higher engine operating temperatures which increases the temperatures to which the spark plugs operating in this restricted space envelope are exposed, making it desirable to improve the ability of the spark plug to remove the heat resulting from operation of the spark plug and the associated combustion processes (i.e., the need for colder spark plugs).

Another common requirement for spark plugs is that they be able to operate without replacement for extended periods of engine and vehicle operation, such as 50,000 or even 100,000 miles of operation.

These space restrictions have led to the use of spark plugs having smaller diameters (e.g., 12 mm, 10 mm and smaller) to achieve the necessary space envelope and heat removal properties, but the manufacture of smaller diameter spark plugs presents other challenges associated with the performance and manufacture of the various spark plug components, such as the insulators and electrode materials.

Another approach has been to extend the spark plug shell maintaining a larger upper portion (e.g., 16 mm), since there is frequently still space available in the head away from the combustion chamber to receive the larger diameter, while reducing the diameter and extending the shell to reach the combustion chamber so as to meet the restricted space envelope requirements. One such spark plug configuration is described in U.S. Pat. No. 5,918,571 to Below which describes an extended shell spark plug where the shell is of two-piece construction of a retainer for the insulator and a ground shield. Below describes the construction by teaching that the insulator and its included center electrode are axially passed into the cylindrical shell ground shield. The flared frustoconical flange of the ground shield engages the insulator shoulder and the cylindrical shell retainer is then passed over the insulator from the opposite end and its interior frustoconical ledge engages a second shoulder of the insulator. A portion of the retainer is then radially collapsed about the flange to secure the ground shield and retainer together with the insulator captured therebetween. The formed portion also serves as the seat for the spark plug. While Below is not specific as to the material of construction, commercial products having the configuration and construction of Below have been observed to utilize a steel retainer and a higher temperature alloy for the ground shield, such as Inconel 600. The two-piece construction has attendant reliability concerns associated concerns when using standard reliability analysis such as Failure Modes Effects Analysis (FMEA) associated with the presence of the additional mechanical compression joint in the spark plug, which has an associated probability of failure. Further, it is believed that placement of the spark plug seat on a formed part which is subject to manufacturing variances associated with two parts may provide an attendant variability of the seat that has a possibility to affect the performance of the seat and the spark plug, as well as the performance of the engine in which it is installed.

While such prior art spark plug designs having extended shells and insulators have achieved their intended purposes. Therefore, a need exists to for spark plugs configured meet the space envelope restrictions while effectively dissipating excessive heat and durable enough to withstand the harsh environments of an internal combustion engine.

SUMMARY OF THE INVENTION

A spark plug for igniting gases in an internal combustion engine is provided. The spark plug has a center electrode in communication with an energy source, an insulator surrounding the center electrode, a one-piece shell surrounding and in contact with the insulator for securing the insulator within the shell, wherein the shell has a plurality of threads near a middle portion and a ground electrode attached to the shell and aligned with a tip of the center electrode at a second end to define a spark gap. A seat is formed in the shell between the plurality of threads and the ground electrode for sealing the shell against the engine. Further, the terminal has a first end in communication with the center electrode and a second end having a connector portion for connecting to the energy source.

In one aspect of the invention, the spark plug includes a center electrode assembly comprising a terminal at one end and a center electrode with a sparking surface at an opposite end; a generally tubular insulator surrounding the center electrode assembly; and a one-piece extended shell surrounding the insulator and having along its length a formed shoulder on a first end, an attachment portion, a threaded portion, a body portion having at an end away from the formed shoulder a tapered seat, a barrel extension and a ground electrode at a second end which is attached to the barrel extension and spaced from the sparking surface to form a spark gap, the ground electrode having a thermally conductive core, wherein the spark plug has an IMEP heat rating greater than about 200. In another aspect of the present invention the insulator has a conical surface near a first end proximate the spark gap.

In yet another aspect of the present invention the insulator has a plurality of sections each having a different diameter.

In yet another aspect of the present invention the section of the insulator disposed between the seat and the tip of the center electrode is in contact with the shell over substantially its entire length.

In yet another aspect of the present invention a gap is defined between the insulator and the shell proximate to the tip of the center electrode.

In yet another aspect of the present invention the seat has a frustoconical shape.

In yet another aspect of the present invention the shell has a hex head formed at the first end for engaging a tool.

In yet another aspect of the present invention an annular groove in the shell defines a narrow wall, wherein the annular groove is disposed between the seat and the plurality of threads.

In yet another aspect of the present invention a section of the insulator is disposed outside of the shell.

In yet another aspect of the present invention the connector has a height that is equal to or less than a third of the height of the section of the insulator that is disposed outside of the shell.

In yet another aspect of the present invention a hot lock seal is formed from said body portion and located between the body portion and the insulator.

In yet another aspect of the present invention the insulator has a distance between the rolled shoulder of their shell and said terminal of at least 0.90 inches.

In yet another aspect of the present invention, the ground electrode includes an Ni alloy and the thermally conductive core includes a Cu alloy.

In yet another aspect of the present invention, the center electrode includes a thermally conductive core.

In yet another aspect of the present invention, the center electrode includes an Ni alloy and the thermally conductive core includes a Cu alloy.

In yet another aspect of the present invention, the center electrode and the ground electrode further include a sparking tip.

In yet another aspect of the present invention, the sparking tip includes one of gold, a gold alloy, a platinum group metal or a tungsten alloy.

In yet another aspect of the present invention, the platinum group metal includes at least one element selected from the group consisting of platinum, iridium, rhodium, palladium, ruthenium and rhenium.

In yet another aspect of the present invention, the platinum group metal further includes at least one element selected from the group consisting of nickel, chromium, iron, manganese, copper, aluminum, cobalt, tungsten, yttrium, zirconium, hafnium, lanthanum, cerium and neodymium.

BRIEF DESCRIPTION OF THE DRAWINGS

These and other features and advantages of the present invention will become more readily appreciated when considered in connection with the following detailed description and appended drawings, wherein.

DETAILED DESCRIPTION OF THE PREFERRED EMBODIMENT

Figure 1:
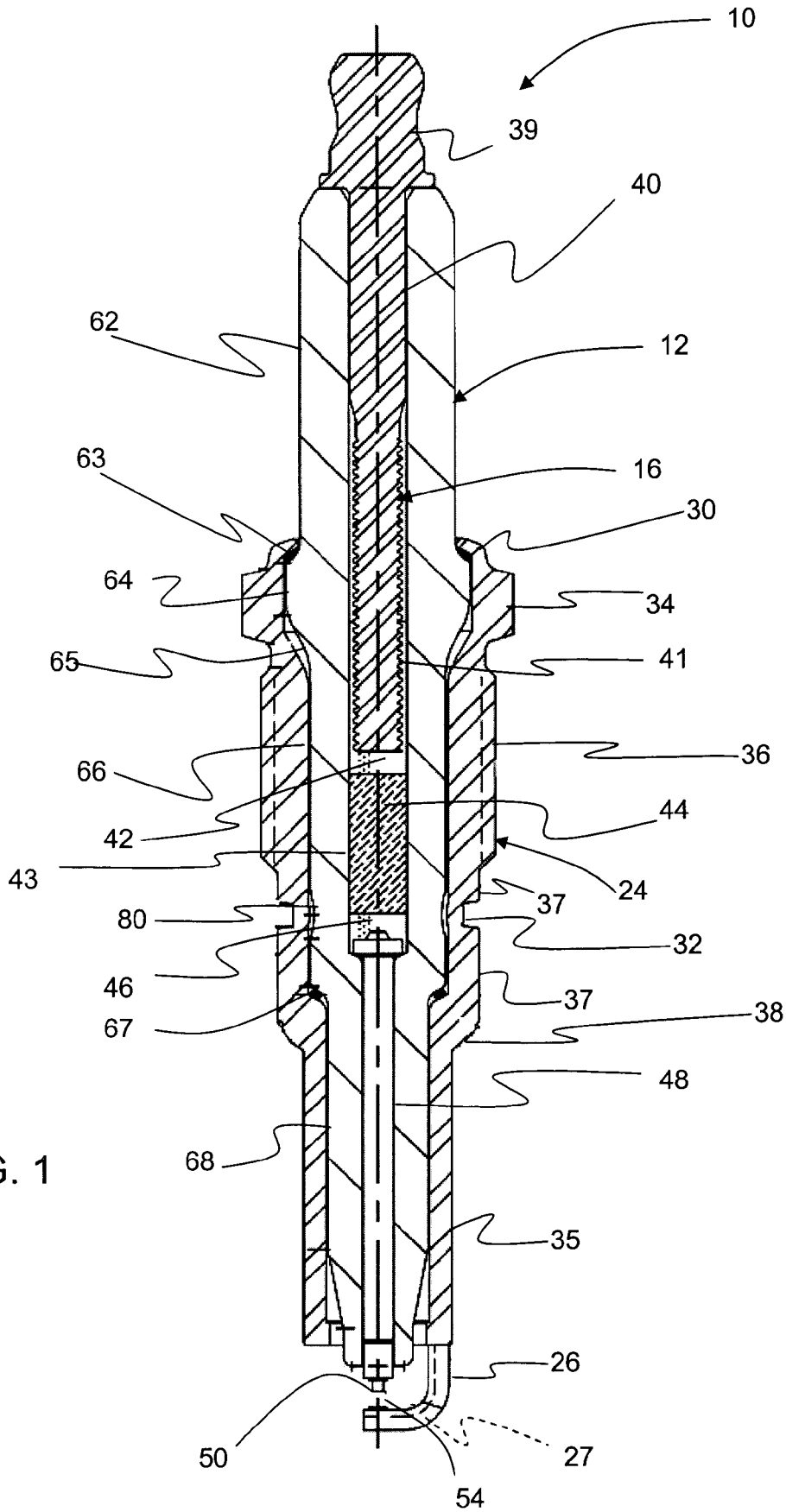
FIG. 1 is a cross-section view of the spark plug in accordance with an embodiment of the present invention.

Referring to the FIGS., wherein like numerals indicate like or corresponding parts throughout the several views, a spark plug according to the subject invention is generally shown at 10 in FIG. 1. Spark plug 10 includes an insulator shown generally at 12, an extended shell shown generally at 24, and a center electrode assembly shown generally at 16. Extended shell 24 is preferably made of an alloy of steel (i.e., 1215 steel) or similar material and is configured, as will be described in further detail below, to retain or capture insulator 12 and center electrode assembly 16. Insulator 12 is a generally cylindrical elongated member made of alumina or similar material. Shell 24 has a section that includes a ground electrode 26 extending therefrom as described further below. FIG. 1 illustrates spark plug 10 in a nearly completely assembled condition, but prior to hot locking the shell and insulator together as described herein. In a fully assembled condition after hot locking as described herein, the buckle zone 32 of shell 24 at least partially collapses in response to heating of this element coupled with application of compressive force which urges the portions of shell 24 above and below this element into pressing engagement with insulator 12. Generally speaking, the description of the elements below, particularly with regard to the engagement of portions of insulator 12 and shell 24 are given in the fully assembled condition (i.e., as if the hot locking operation had been performed).

Figure 2:
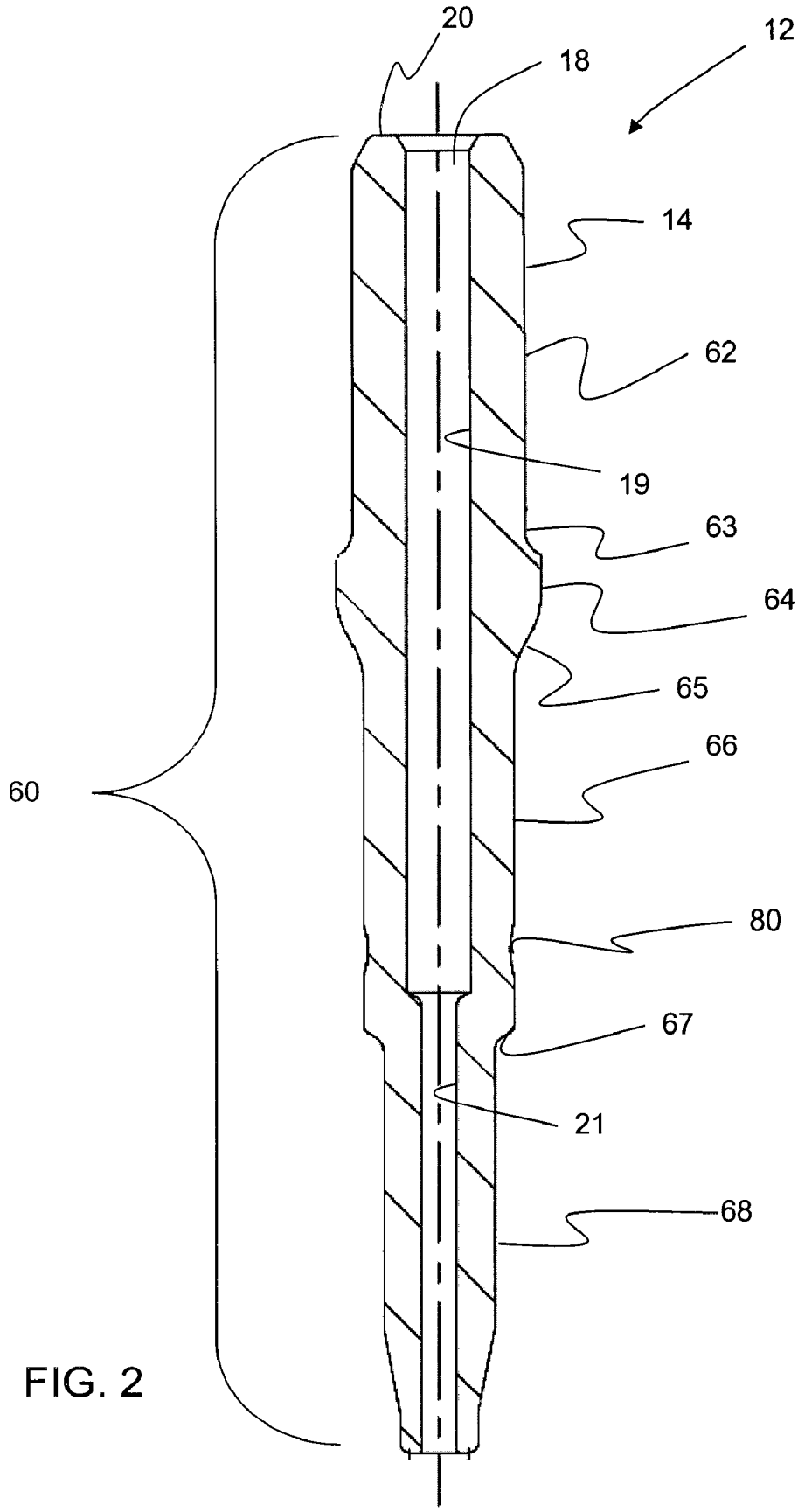
FIG. 2 is a cross-section view of an insulator in accordance with an embodiment of the present invention.

Referring to FIGS. 1 and 2, the spark plug 10 includes a tubular ceramic insulator, generally indicated at 12, which is preferably made from aluminum oxide or other suitable material having a specified dielectric strength, high mechanical strength, high thermal conductivity, and excellent resistance to thermal shock. The insulator 12 may be molded dry under extreme pressure and then sintered at high temperature using well-known processes. The insulator 12 has an outer surface which may include a partially exposed upper mast portion 14 to which an elastomeric spark plug boot (not shown) surrounds and grips to maintain an operative electrical connection with the ignition system. The exposed mast portion 14, as shown in FIG. 1, may include a series of ribs (not shown) for the purpose of providing added protection against spark or secondary voltage "flashover" and to improve the grip with an elastomeric spark plug boot. The insulator 12 is of generally tubular or annular construction, including a central passage 18, extending longitudinally between an upper portion 19 proximate terminal end 20 and a lower portion 21 proximate core nose end 22. The central passage 18 is of varying cross-sectional area, generally greatest at or adjacent the terminal end 20 and smallest at or adjacent the core nose end 22. Referring again to FIGS. 1 and 2, generally tubular insulator 12 surrounds center electrode assembly 16 described below. Insulator 12 includes generally a continuous series of tubular sections 60 of varying diameter. These sections include a first insulator section 62 which surrounds the stud portion 41 of terminal stud 40. This first insulator section 62 transitions to a first insulator shoulder 63 which is in pressing engagement with the formed shoulder 30 of shell 24 described herein and in turn transitions to a second insulator section 64. Second insulator section 64 has a diameter which is greater than the diameter of the first insulator section 62 and is housed within the first shell section 72 as described herein. A second insulator shoulder 65 is in pressing engagement with the first shell shoulder 73 and transitions to a third insulator section 66. The third insulator section 66 has a diameter less than the diameter of the second insulator section 64, and preferably less than the diameter of the first insulator section 62, and is housed within the second shell section 74. A third insulator shoulder 67 is in pressing engagement with the second shell shoulder 28 and transitions to a fourth insulator section 68. Fourth insulator section 68 has a diameter which is less than the diameter of the third insulator section. Fourth insulator section 68 is housed within the third shell section 76 and includes a tapered core nose section 69. Fourth insulator section 68 and its core nose section 69 house most of center electrode 48. Electrode extends from the barrel extension 35 of shell 24 and is proximate the spark gap 54. The fourth insulator section 68 and barrel extension play an important role in removing heat from the spark plug and the heat transfer characteristics of these components play a significant role in establishing the operating temperature of the spark plug and its IMEP rating as described herein. The fourth insulator section 68 and the third shell section 76 are sufficiently closely spaced and operative for removal of heat from the fourth insulator section through the third shell section as described herein. Insulator 10 also preferably includes a pocket 80 which is adapted to receive a portion of buckle zone 32 when the insulator 12 and shell 48 are hot locked as described herein.

Figure 3:
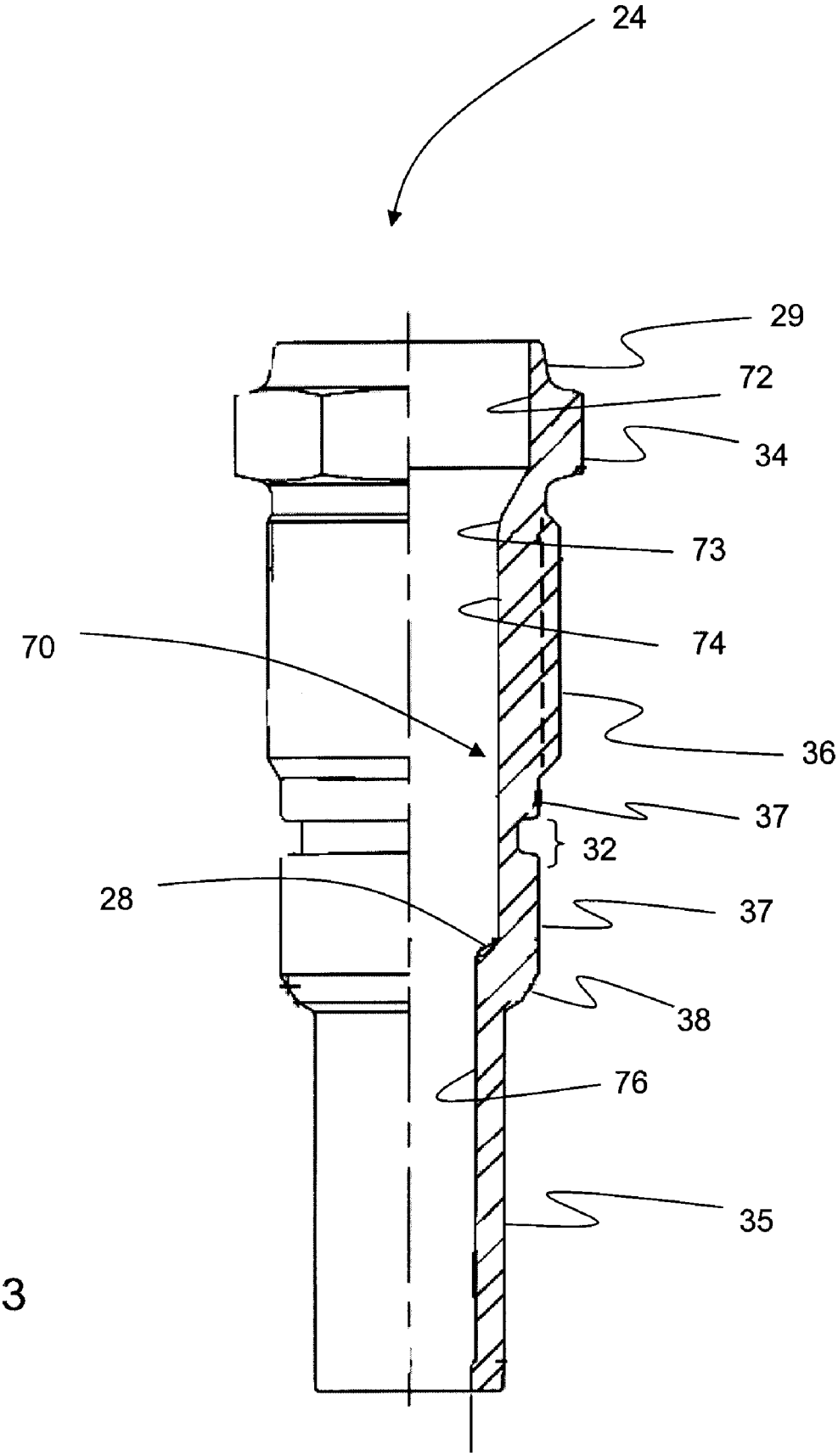
FIG. 3 is a cross-section view of a shell prior to attachment of a ground electrode in accordance with an embodiment of the present invention.
Figure 4:
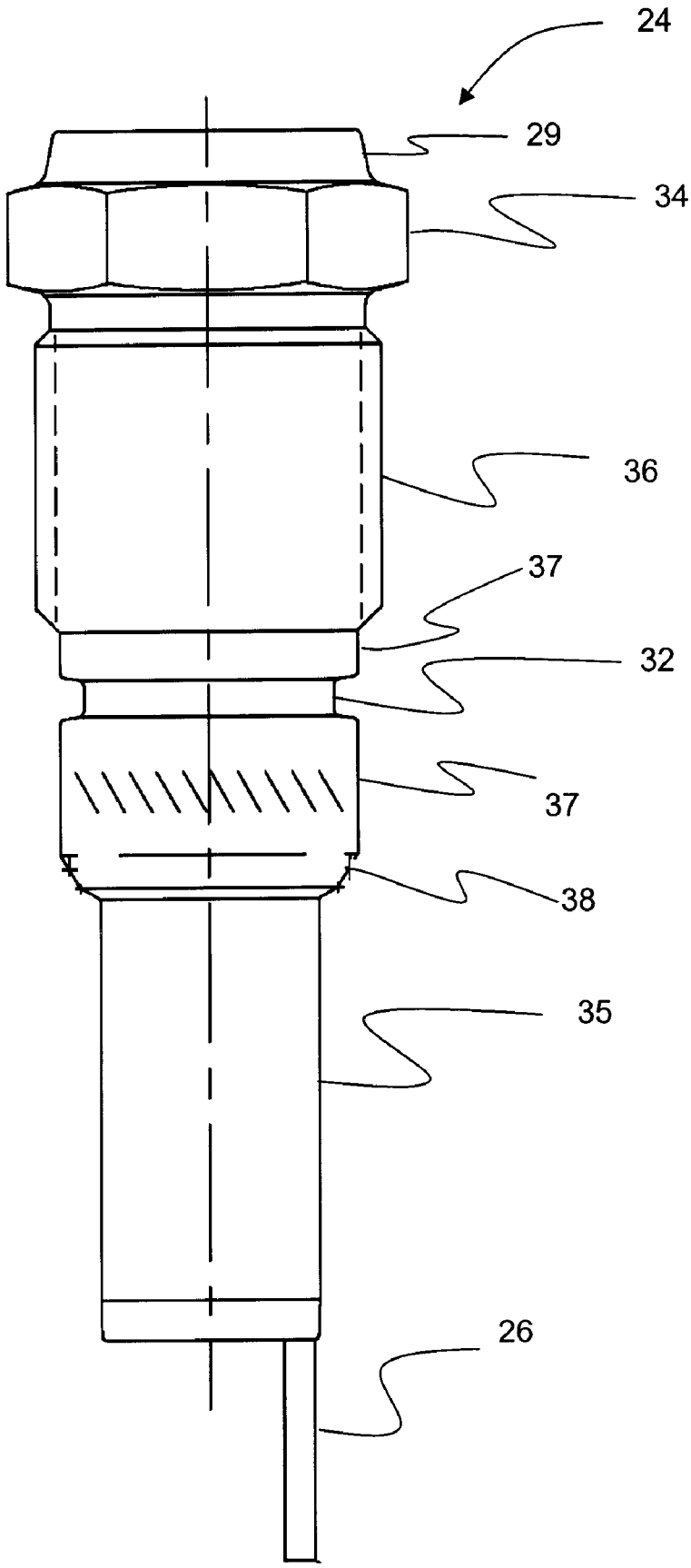
FIG. 4 is a front view of a shell after attachment of a ground electrode in accordance with an embodiment of the present invention.
Figure 5:
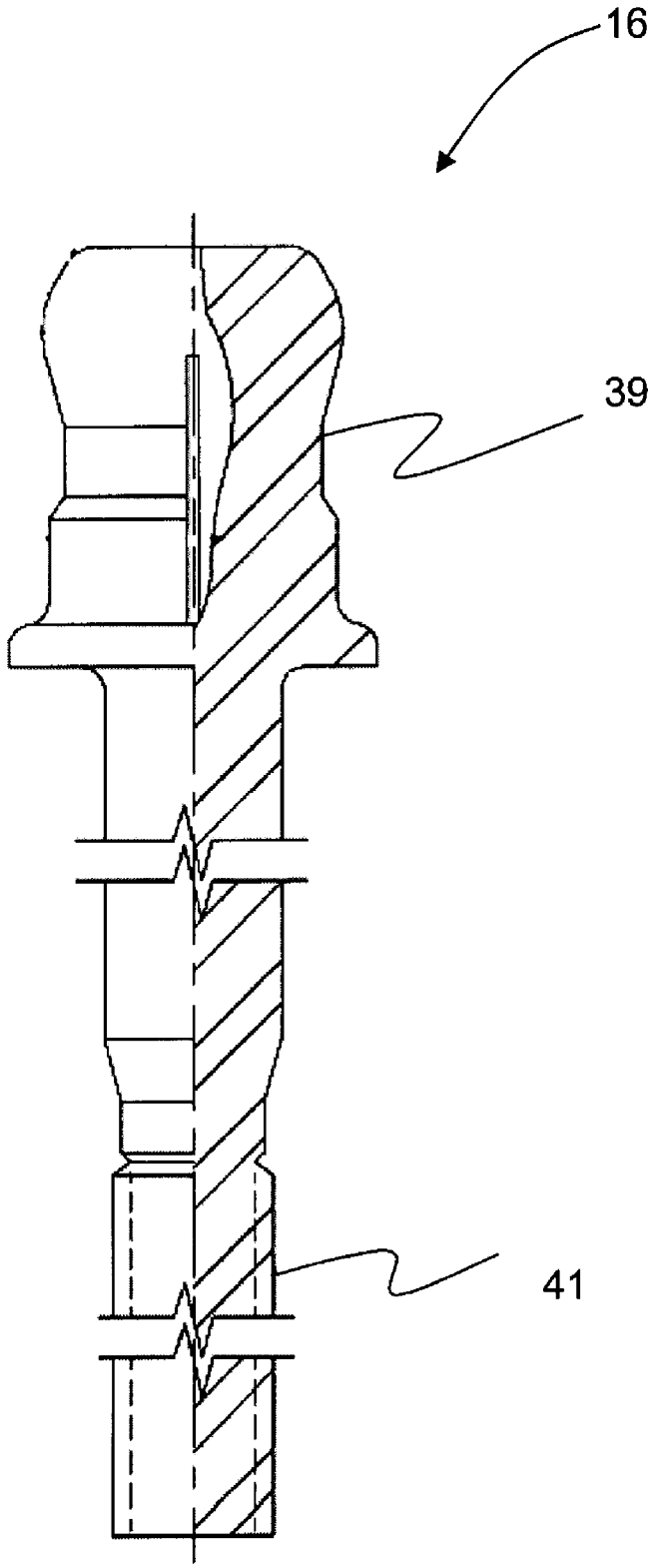
FIG. 5 is a section view of a terminal in accordance with an embodiment of the present invention.
Figure 6:
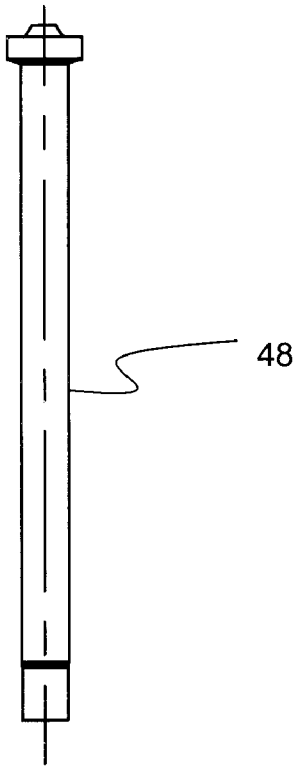
FIG. 6 is a front view of a center electrode in accordance with an embodiment of the present invention.

As depicted generally in FIGS. 1, 3 and 4, an electrically conductive, preferably metallic, extended shell is generally indicated at 24. By extended, for a 16 mm spark plug example, it is meant that the shell 24 may have an overall length on the order of about 1.2 inches or more. Extended shell 24 may be made from any suitable metal, including various coated and uncoated steel alloys, such as 1215 steel. Shell 24 may be coated by plating or otherwise with protective coatings such as Ni or Ni alloys. The extended shell 24 has a generally annular interior surface or bore 70 which surrounds and is adapted for pressing and sealing engagement with the exterior surface of insulator 12 as described herein and includes at least one attached ground electrode 26. The shell 24 surrounds the lower sections, including second 64, third 66 and fourth 68 insulator sections of the insulator 12 and includes at least one ground electrode 26. While the ground electrode 26 is depicted before bending FIG. 4 and in the traditional single L-shaped style in FIG. 1, it will be appreciated that multiple ground electrodes of L-shape, straight or bent configuration can be substituted depending upon the desired ground electrode configuration and the intended application for the spark plug 10.

Extended shell 24 has a generally tubular or annular bore 70 in its body section and includes an internal lower compression flange or second shoulder 28 adapted to bear in pressing contact against third insulator shoulder 67 of the insulator 12. Extended shell 24 further includes an upper compression flange or formed shoulder 30 which is crimped or formed over during the assembly operation to bear in pressing contact against first insulator shoulder 63 of insulator 12. This is formed from a shoulder portion 29 which is shown in FIGS. 3 and 4 prior to deformation to create formed shoulder 30. Extended shell may also include a deformable zone 32 which is designed and adapted to collapse axially and radially inwardly in response to heating of deformable zone 32 and associated application of an overwhelming axial compressive force during or subsequent to the deformation of formed shoulder 30 in order to hold extended shell 24 in a fixed axial position with respect to insulator 12 and form a gas tight radial seal between insulator 12 and extended shell 24. Gaskets, cement, or other sealing compounds can be interposed between the insulator 12 and shell 24 to perfect a gas-tight seal and improve the structural integrity of the assembled spark plug 10.

The shell 24 is provided with an attachment portion 34, such as a tool receiving hexagon 34 or other feature for removal and installation of the spark plug in a combustion chamber opening. The feature size will preferably conform with an industry standard tool size of this type for the related application. The hex size complies with industry standards for the related application. Of course, some applications may call for a tool receiving interface other than a hexagon, such as slots to receive a standard spanner wrench, or other features such as are known in racing spark plug and other applications and in other environments. A threaded portion 36 is formed below the attachment portion 34 to be used for engagement with a threaded bore in the cylinder head of an engine. Immediately below threaded portion 36 is body portion 37. Body portion 37 has at the end located away from formed shoulder 30 a sealing seat 38. The seat 38 may be a squared shoulder paired with a gasket (not shown) to provide a suitable interface against which the spark plug 10 seats in the cylinder head and provides a hot gas seal of the space between the outer surface of the shell 24 and the threaded bore in the combustion chamber opening (not shown). Alternatively and preferably, the sealing seat 38 may be designed with a tapered seat located along the lower end of body portion 37 of the shell 24 to provide a close tolerance and self-sealing installation in a cylinder head which is also typically designed with a mating taper for this style of spark plug. Disposed below sealing seat 38 is barrel extension 35. Barrel extension 35 may be on the order of 0.85 inches in length with an outer diameter of generally less than about 0.40 inches and a wall thickness of about 0.060 inches and permits spark plug 10 to satisfy the reduced space envelope requirements proximate the combustion chamber while also providing the necessary interface with the other components of spark plug 10. Attached to the free end of barrel extension 35 is ground electrode 26.

As illustrated in FIGS. 3 and 4, extended shell 24 has an annular bore 70 with sections of varying diameters which are progressively reduced from the formed shoulder 30 to the free end of barrel extension 35. They include a first shell section 72 associated with formed shoulder 30 and attachment portion 34. Extending from first shell section 72 is first shell shoulder 73 which is adapted for pressing engagement with second insulator shoulder 65 and in turn transitions to a second shell section 74. Second shell section 74 is associated with threaded portion 36 and an end of said body portion 37 located toward formed shoulder 30. Extending from second shell section 74 is second shell shoulder 28 which is adapted for pressing engagement with third insulator shoulder 67. Second shell shoulder 28 transitions to third shell section 76 which is associated with said end of said body portion away 37 from the formed shoulder 30 and with barrel extension 35.

As shown in FIG. 1, an electrically conductive terminal stud 40 is partially disposed in the central passage 18 of the insulator 12 and extends longitudinally from an exposed top post 39 to a bottom end 41 embedded partway down the central passage 18. The top post 39 may be a bantam post having a reduced height of about 0.35 inches or may have a more conventional height. It is adapted for connection to an ignition wire terminal (not shown) and receives timed discharges of high voltage electricity required to fire or operate the spark plug 10 by generating a spark in spark gap 54.

The bottom end 41 of the terminal stud 40 is embedded within a conductive glass seal 42, forming the top layer of a composite three layer suppressor-seal pack. The conductive glass seal 42 functions to seal the bottom end 41 of the terminal stud 40 and electrically connect it to a resistor layer 44. This resistor layer 44, which comprises the center layer of the three-layer suppressor-seal pack 43, can be made from any suitable composition. Depending upon the recommended installation and the type of ignition system used, such resistor layers 44 may be designed to function as a more traditional resistor suppressor or, in the alternative, as a low resistance. Immediately below the resistor layer 44, another conductive glass seal 46 establishes the bottom or lower layer of the suppressor-seal pack 43 and electrically connects terminal stud 40 and suppressor-seal pack 43 to the center electrode 48. Top layer 42 and bottom layer 46 may be made from the same conductive material or different conductive materials. Many other configurations of glass and other seals and EMI supressors are well-known and may also be used in accordance with the invention. Accordingly, electricity from the ignition system travels through the bottom end 41 of the terminal stud 40 to the top portion of conductive glass seal 42, through the resistor layer 44, and into the lower conductive glass seal layer 46.

As shown in FIG. 1, conductive center electrode 48 is partially disposed in the central passage 18 and extends longitudinally from its head which is encased in the lower glass seal layer 46 to its exposed sparking end 50 proximate the ground electrode 26. The suppressor-seal pack 43 electrically interconnects the terminal stud 40 and the center electrode 48, while simultaneously sealing the central passage 18 from combustion gas leakage and also suppressing radio frequency noise emissions from the spark plug 10. As shown, the center electrode 48 is preferably a one-piece unitary structure extending continuously and uninterrupted between its head and its sparking end 50. Conductive center electrode 48 is preferably formed from an electrically conductive material which combines high thermal conductivity with high temperature strength and corrosion resistance. Among suitable materials for conductive center electrode 48 are various Ni-based alloys, including various nickel-chromium-iron alloys, such as those designated generally by UNS N06600 and sold under the trademarks Inconel 600®, Nicrofer 7615®, and Ferrochronin 600®, as well as various dilute nickel alloys, such as those comprising at least 92% by weight of nickel; and at least one element from the group consisting of aluminum, silicon, chromium, titanium and manganese. These alloys may also include rare earth alloying additions to improve certain high temperature properties of the alloys, such as at least one rare earth element selected from the group consisting of yttrium, hafnium, lanthanum, cerium and neodymium. They may also incorporate small amounts of zirconium and boron to further enhance their high temperature properties as described in commonly assigned, co-pending U.S. patent applications Ser. Nos. 11/764,517 and 11/764,528 filed on Jun. 18, 2007 which are hereby incorporated herein by reference in their entirety.

Either one or both of the ground electrode 26 and center electrode 48 can also be provided with a thermally conductive core. This core 27 is shown in the case of ground electrode 26 in FIGS. 1 and 9. In the case of center electrode 48, it is shown as core 49 in FIGS. 7 and 8. Thermally conductive core is made from a material of high thermal conductivity (e.g., ≧250 W/M*° K.) such as copper or silver or various alloys of either of them. Highly thermally conductive cores serve as heat sinks and help to draw heat away from the spark gap 54 region during operation of the spark plug 10 and the associated combustion processes, thereby lowering the operating temperature of the electrodes in this region and further improving their performance and resistance to the degradation processes described herein.

Figure 7:
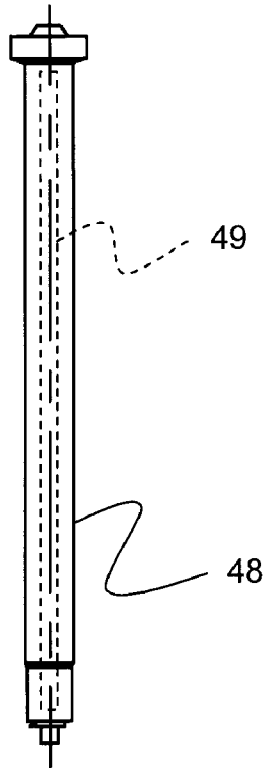
FIG. 7 is a front view of a center electrode with a sparking tip attached to a sparking end thereof in accordance with an embodiment of the present invention.
Figure 8:
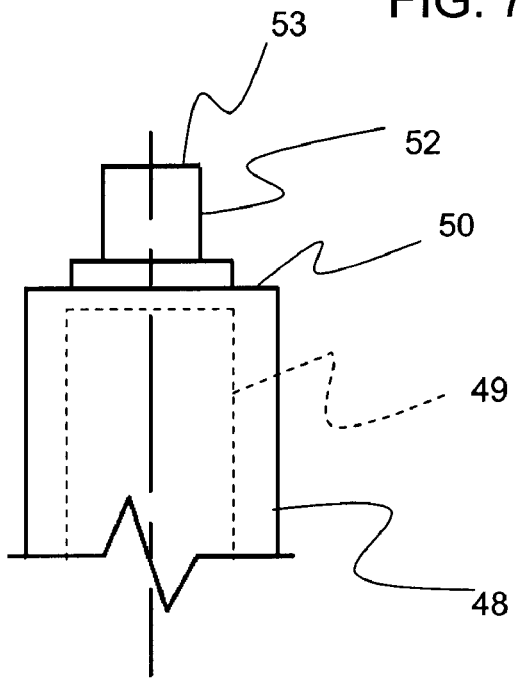
FIG. 8 is an enlarged view of the sparking tip of FIG. 7.
Figure 9:
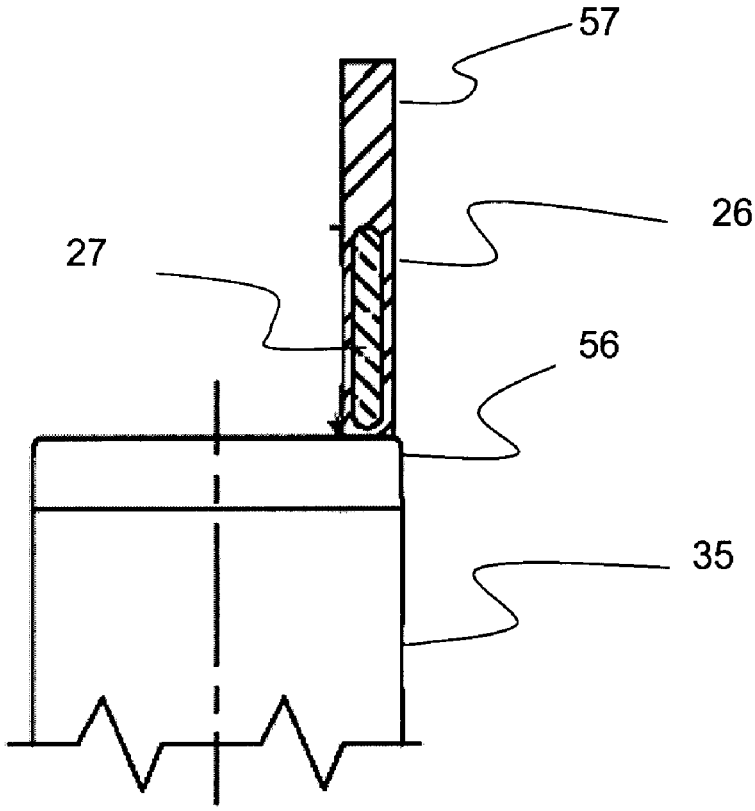
FIG. 9 is a partial cross-section view of a ground electrode and barrel portion of the shell in accordance with an embodiment of the present invention.
Figure 10:
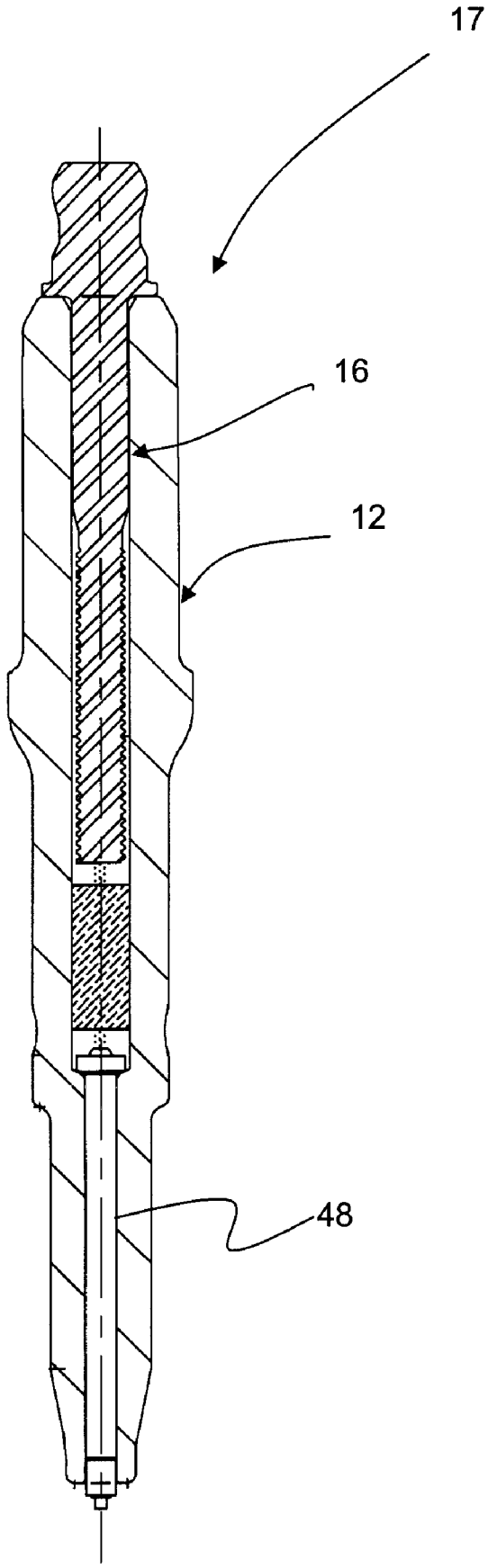
FIG. 10 is a cross-section view of a insulator and terminal assembly in accordance with an embodiment of the present invention.

A firing tip 52 may optionally be located at the sparking end 50 of the center electrode 48, as shown in FIGS. 1, 7 and 8. The firing tip 52 provides a sparking surface 53 for the emission of electrons across a spark gap 54. The firing tip 52 for the center electrode 48 can be made according to any of the known techniques, including loose piece formation and subsequent attachment by various combinations of resistance welding, laser welding, or combinations thereof, of a pad-like, wire-like or rivet-like member made from any of the known precious metal or high performance alloys including, but not limited to, gold, a gold alloy, a platinum group metal or a tungsten alloy. Gold alloys, including Au—Pd alloys, such as Au-40Pd (in weight percent) alloys. Platinum group metals, include: platinum, iridium, rhodium, palladium, ruthenium and rhenium, and various alloys thereof in any combination. For purposes of this application, rhenium is also included within the definition of platinum group metals based on its high melting point and other high temperature characteristics similar to those of certain of the platinum group metals. Firing tips 52 may also be made from various tungsten alloys, including W—Ni, W—Cu and W—Ni—Cu alloys. Additional alloying elements for use in firing tips 52 may include, but are not limited to, nickel, chromium, iron, manganese, copper, aluminum, cobalt, tungsten, zirconium, and rare earth elements including yttrium, lanthanum, cerium, and neodymium. In fact, any material that provides good erosion and corrosion performance in the combustion environment may be suitable for use in the material composition of the firing tip 52. Further, firing tip 52 may be a composite firing tip 52 having a free end portion located away from the center electrode 48 that includes the sparking surface 53, which is a precious metal or high performance alloy, such as those described above, and a base end portion which is attached to the center electrode 48 on a base end and on the other end to the free end portion. The base end portion may be any material suitable for attachment to the free end portion, such as the Ni-based electrode materials described herein. The free end portion and base end portion may be joined together by any suitable joining method, such as various forms of welding. Depending on the materials selected for use as the free end portion and the base end portion and the joining method employed, the composite sparking tip 52 will also have joint between them. The joint may have a coefficient of thermal expansion (CTE) that is between the CTE's of the materials used for the free end portion and the base end portion, or may fall outside this range, depending on the materials selected for free end portion and the base end portion and the method used to form the joint. This composite or multi-layer sparking tip structure may be formed as a wire or headed rivet. The tip structures and methods of making and using them are explained further in commonly assigned, co-pending U.S. patent applications Ser. Nos. 11/602,028; 11/602,146; and 11/602,169 filed on Nov. 20, 2006 which are hereby incorporated herein by reference in their entirety. These sparking tips have numerous advantages, including reduced materials costs as compared to all precious metal or high performance alloy tips. They are also more easily welded to the center or grounds electrodes because the base end may be formed from the same or similar alloys used to make the electrodes, such as various nickel-based alloys. Because they may be made from the same or similar alloys as the electrodes themselves, they also have a significantly reduced CTE mismatch, which improves the resistance to thermal stress and cycling induced cracking and fracture of the interface between the base portion of the sparking tip and the electrode.

As perhaps best shown in FIG. 1, the ground electrode 26 extends from an anchored end 56 adjacent the shell 24 to a distal end 58 adjacent the sparking gap 54. The ground electrode 26 may be of the typical rectangular cross-section, including an nickel-based alloy jacket surrounding a copper or other thermally conductive material core (see FIGS. 1 and 9).

Spark plug 10 has demonstrated an industry standard IMEP rating of about 212, it is believed that spark plugs of this construction can routinely achieve an IMEP rating of 200 or more, particularly by the incorporation of cored center and ground electrodes of the types described above. Spark plugs 10 also avoid two-piece shell construction and the potential limitations associated therewith described herein, including the need for the use of high temperature alloys for a portion of the shell. These are believed to offer significant reliability and cost advantages.

Generally, the elements of terminal assembly 16 are assembled in insulator to form an insulator and terminal assembly 17 as described herein. Insulator and terminal assembly 17 is inserted into the formable section 29 at the end of shell 24 and is captured therein as described herein. This has the advantage of insertion and assembly from a single end in contrast to assembly methods used when two-piece shells are employed, where separate shell portion must be inserted over opposite ends of the insulator and joined together to form the spark plug shell.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly, the scope of legal protection afforded this invention can only be determined by studying the following claims.

What is claimed is:

1. A spark plug, comprising:

a center electrode assembly comprising a terminal at one end and a center electrode with a sparking surface at an opposite end;

a generally tubular insulator surrounding said center electrode assembly;

a one-piece extended shell surrounding said insulator and having along its length a formed shoulder on a first end, an attachment portion, a threaded portion, a body portion having at an end away from the formed shoulder a seat, a barrel extension and a ground electrode at a second end which is attached to said barrel extension and spaced from said sparking surface to form a spark gap, said ground electrode having a thermally conductive core; and a previously deformed buckle zone in said body portion between said threaded portion and said seat.

2. The spark plug of claim 1 wherein said attachment portion comprises a hex head.

3. The spark plug of claim 1, wherein said insulator has a distance between said formed shoulder of said shell and said terminal of at least 0.9 inches.

4. The spark plug of claim 1, wherein said ground electrode comprises a Ni alloy and said thermally conductive core comprises a Cu alloy.

5. The spark plug of claim 1, wherein said center electrode comprises a thermally conductive core.

6. The spark plug of claim 5, wherein said center electrode comprises a Ni alloy and said thermally conductive core comprises a Cu alloy.

7. The spark plug of claim 1, wherein at least one of said center electrode and said ground electrode further comprises a sparking tip.

8. The spark plug of claim 7, wherein said sparking tip comprises one of gold, a gold alloy, a platinum group metal or a tungsten alloy.

9. The spark plug of claim 8, wherein said platinum group metal comprises at least one element selected from the group consisting of platinum, iridium, rhodium, palladium, ruthenium and rhenium.

10. The spark plug of claim 9, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

11. The spark plug of claim 1 wherein said seat has a frustoconical taper.

12. A spark plug, comprising:

a center electrode assembly comprising a terminal at one end and a center electrode with a sparking surface at an opposite end;

a one-piece extended shell having along its length a formed shoulder on a first end, an attachment portion, a threaded portion, a body portion having at an end away from the formed shoulder a tapered seat, a barrel extension and a ground electrode at a second end which is attached to said barrel extension and spaced from said sparking surface to form a spark gap, said shell having an annular bore with sections of varying diameters which are progressively reduced from said formed shoulder to said second end comprising a first shell section associated with said formed shoulder and said attachment portion, a first shell shoulder which transitions to a second shell section associated with said threaded portion and an end of said body portion toward said formed shoulder, a second shell shoulder which transitions to a third shell section which is associated with said end of said body portion away from said formed shoulder and said barrel extension, said ground electrode having a thermally conductive core;

a generally tubular insulator surrounding said center electrode assembly, said insulator having tubular sections of varying diameter comprising a first insulator section which surrounds said terminal, a first insulator shoulder which is in pressing engagement with said formed shoulder and transitions to a second insulator section having a diameter which is greater than a diameter of said first insulator section and housed within said first shell section, a second insulator shoulder which is in pressing engagement with said first shell shoulder and transitions to a third insulator section having a diameter less than the diameter of said second insulator section and housed within said second shell section, a third insulator shoulder which is in pressing engagement with said second shell shoulder and transitions to a fourth insulator section having a diameter which is less than the diameter of said third insulator section and housed within said third shell section, and a tapered core nose section housing said electrode which extends from said barrel extension and is proximate the spark gap; wherein said fourth insulator section and said third shell section are sufficiently closely spaced and operative for removal of heat from said fourth insulator section through said third shell section; and a previously deformed buckle zone in said body portion between said threaded portion and said tapered seat.

13. The spark plug of claim 12, wherein said fourth insulator section has a controlled maximum diametral straightness variation along its length.

14. The spark plug of claim 13, wherein said maximum diametral straightness variation is 0.008 inches.

15. The spark plug of claim 12, wherein said spark plug has an IMEP heat rating of at least 200.

16. The spark plug of claim 12, wherein said attachment portion comprises a hex head.

17. The spark plug of claim 12, wherein said first insulator section has a flashover distance between said formed shoulder of said shell and said terminal of at least 0.9 inches.

18. The spark plug of claim 12, wherein said ground electrode comprises a Ni alloy and said thermally conductive core comprises a Cu alloy.

19. The spark plug of claim 12, wherein at least one of said center electrode and said ground electrode further comprises a sparking tip.

20. The spark plug of claim 19, wherein said sparking tip comprises one of gold, a gold alloy, a platinum group metal or a tungsten alloy.

21. The spark plug of claim 20, wherein said platinum group metal comprises at least one element selected from the group consisting of platinum, iridium, rhodium, palladium, ruthenium and rhenium.

22. The spark plug of claim 21, wherein said platinum group metal further comprises at least one element selected from the group consisting of nickel, chromium, iron, manganese, copper, aluminum, cobalt, tungsten, yttrium, zirconium, hafnium, lanthanum, cerium and neodymium.

* * * * *